US009651047B2

(12) United States Patent
Yamashita et al.

(10) Patent No.: US 9,651,047 B2
(45) Date of Patent: May 16, 2017

(54) COMPRESSOR HAVING A PARTITIONED DISCHARGE CHAMBER

(71) Applicant: KABUSHIKI KAISHA TOYOTA JIDOSHOKKI, Aichi-ken (JP)

(72) Inventors: Takuro Yamashita, Kariya (JP); Jun Yamazaki, Kariya (JP); Kunihisa Matsuda, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 211 days.

(21) Appl. No.: 14/587,571

(22) Filed: Dec. 31, 2014

(65) Prior Publication Data

US 2015/0198159 A1 Jul. 16, 2015

(30) Foreign Application Priority Data

Jan. 10, 2014 (JP) ..... 2014-003535

(51) Int. Cl.
*F01C 1/063* (2006.01)
*F03C 2/02* (2006.01)
(Continued)

(52) U.S. Cl.
CPC ..... *F04C 29/12* (2013.01); *F04C 18/0215* (2013.01); *F04C 23/008* (2013.01); *F04C 29/028* (2013.01)

(58) Field of Classification Search
CPC ..... F04C 29/12; F04C 29/028; F04C 29/023; F04C 29/026; F04C 29/0254; F04C 29/0261
(Continued)

(56) References Cited

U.S. PATENT DOCUMENTS 6,237,362 B1 5/2001 Jang
2002/0136652 A1* 9/2002 Gennami ..... F04C 23/008 418/55.6
(Continued)

FOREIGN PATENT DOCUMENTS

JP 07-133772 5/1995
JP 11-082353 3/1999
(Continued)

OTHER PUBLICATIONS

English machine translation Japanese Patent 2008-88945 by J-Piat Pat, Sep. 12, 2016.*
(Continued)

*Primary Examiner* — Deming Wan
(74) *Attorney, Agent, or Firm* — Greenblum & Bernstein, P.L.C.

(57) ABSTRACT

A compressor includes a discharge housing member, which includes a discharge chamber and an oil separation chamber. The discharge housing member includes a cylindrical wall defining the discharge chamber and the oil separation chamber. The discharge chamber includes a partition that is continuous with and protrudes from the cylindrical wall. The cylindrical wall extends from an upper section of the discharge chamber toward a lower section of the discharge chamber. The cylindrical wall includes a communication hole connecting the discharge chamber to the oil separation chamber. The partition extends from the upper section of the discharge chamber toward the lower section of the discharge chamber and defines a first space and a second space in the discharge chamber. The first space and the second space are connected to each other at least at the lower section of the discharge chamber through a clearance between the partition and the circumferential wall.

10 Claims, 2 Drawing Sheets

(51) Int. Cl.

| | |
|---|---|
| ***F04C 2/02*** | (2006.01) |
| ***F04C 29/12*** | (2006.01) |
| ***F04C 23/00*** | (2006.01) |
| ***F04C 29/02*** | (2006.01) |
| ***F04C 18/02*** | (2006.01) |

(58) Field of Classification Search
USPC ..... 418/55.6, 55.1, DIG. 1, 55.2
See application file for complete search history.

(56) References Cited

U.S. PATENT DOCUMENTS

2005/0265878 A1* 12/2005 Ishida ..... F04C 29/026 418/55.1
2006/0153725 A1* 7/2006 Koide ..... F04C 18/0215 418/55.6
2006/0171832 A1* 8/2006 Oiwake ..... F04B 27/109 418/55.6
2009/0191081 A1* 7/2009 Lee ..... F04C 18/0215 418/55.6
2009/0285708 A1* 11/2009 Yokoi ..... F04C 18/0215 418/55.6
2013/0251548 A1* 9/2013 Ohno ..... F04C 18/0215 417/228

FOREIGN PATENT DOCUMENTS

| | | | |
|---|---|---|---|
| JP | 2001-227467 | 8/2001 | |
| JP | 2005-325734 | 11/2005 | |
| JP | 2006-037894 | 2/2006 | |
| JP | 2008-088945 | 4/2008 | |
| WO | WO 2010050622 A1 * | 5/2010 | ..... F01C 21/10 |

OTHER PUBLICATIONS

English machine translation WO 2010050622 by Espacenet, Sep. 12, 2016.*
English machine translation Japanese Patent Publication 2005-325734 by J-Piat Pat, Sep. 14, 2016.*

* cited by examiner

COMPRESSOR HAVING A PARTITIONED DISCHARGE CHAMBER

BACKGROUND OF THE INVENTION

The present invention relates to a compressor.

Refrigerant gas that flows in a compressor typically contains lubricant to lubricate sliding parts in the compressor in a favorable manner. However, circulating the refrigerant gas that contains lubricant between an external refrigerant circuit and the compressor reduces the efficiency of a refrigeration cycle. To prevent the refrigerant gas containing lubricant from flowing to the external refrigerant circuit from the compressor, a compressor equipped with an oil separator for separating the lubricant from the refrigerant gas has been disclosed in, for example, Japanese Laid-Open Patent Publication No. 11-82353. The oil separator includes an outer tube located in a discharge chamber, an inner tube arranged in the outer tube, and a hollow portion that is an oil separation chamber formed between the outer tube and the inner tube. The refrigerant gas introduced from the discharge chamber to the hollow portion swirls around the inner tube so that the lubricant is separated from the refrigerant gas.

The compressor of Japanese Laid-Open Patent Publication No. 11-82353 is arranged such that the inner tube extends vertically to improve particularly the separation efficiency of the oil separator. Thus, the refrigerant gas in the discharge chamber needs to be introduced from the upper section of the discharge chamber into the hollow portion. This causes the lubricant separated from the refrigerant gas in the discharge chamber to easily accumulate in the lower part of the discharge chamber. For this reason, in anticipation of accumulation of lubricant in the lower part of the discharge chamber, an extra lubricant of the amount corresponding to the anticipated accumulation needs to be included in the compressor in advance.

SUMMARY OF THE INVENTION

Accordingly, it is an objective of the present invention to provide a compressor that reduces the amount accumulation of lubricant that has been separated in a discharge chamber in a lower part of the discharge chamber with a simple structure.

In accordance with one aspect of the present invention and in accordance with one aspect of the present invention, a compressor is provided that includes a compression chamber, a discharge port connected to the compression chamber, a cylindrical discharge housing member including an end wall and a circumferential wall, a discharge chamber that is formed in the discharge housing member to receive refrigerant gas compressed in the compression chamber and discharged via the discharge port, and an oil separation chamber formed in the discharge housing member. The oil separation chamber accommodates an oil separation tube that separates lubricant contained in the refrigerant gas discharged to the discharge chamber from the refrigerant gas. The compressor further includes a cylindrical wall and a partition. The cylindrical wall is formed on the end wall of the discharge housing member, and the cylindrical wall defines the discharge chamber and the oil separation chamber. The partition is provided in the discharge chamber, and the partition is continuous with and protruding from the cylindrical wall. The cylindrical wall bulges into the discharge chamber and extends from an upper section of the discharge chamber toward a lower section of the discharge chamber, and the cylindrical wall includes, at a position corresponding to the upper section, a communication hole connecting the discharge chamber to the oil separation chamber. The partition extends from the upper section of the discharge chamber toward the lower section of the discharge chamber and defines a first space adjacent to the discharge port and a second space adjacent to the communication hole in the discharge chamber. The first space and the second space are connected to each other at least at the lower section of the discharge chamber through a clearance between the partition and the circumferential wall.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A compressor according to one embodiment, which is a scroll compressor 10, will now be described with reference to FIGS. 1 to 3. The scroll compressor 10 of the present embodiment is installed in a vehicle and is used for a vehicle air conditioning system. The terms up and down used in the present description are defined with reference to the direction of gravity.

Figure 1:
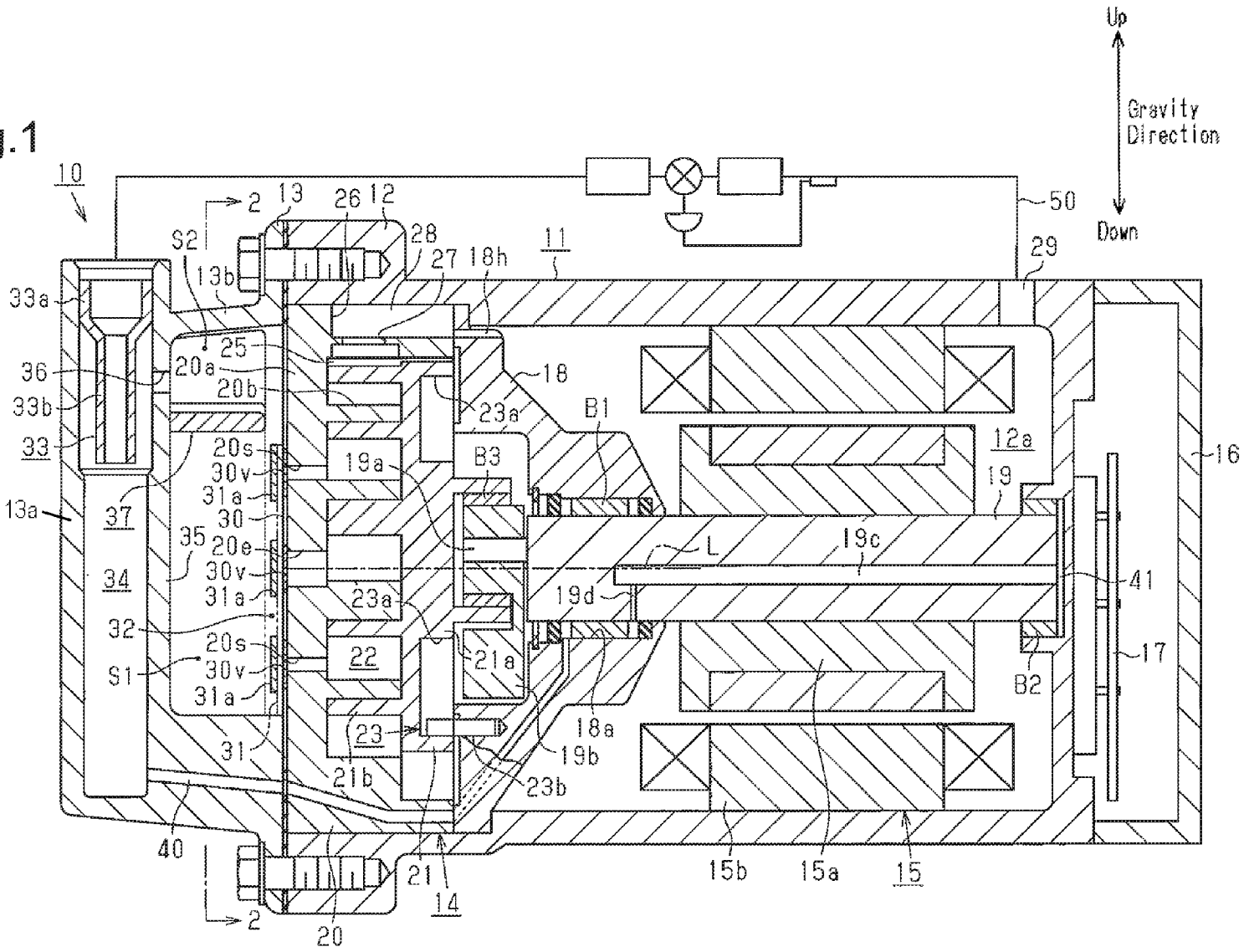
FIG. 1 is a longitudinal cross-sectional view illustrating a scroll compressor according to one embodiment.

As shown in FIG. 1, the scroll compressor 10 includes a housing 11 formed of metal material (in the present embodiment, aluminum). The housing 11 includes a cylindrical suction housing member 12 and a cylindrical discharge housing member 13. The cylindrical suction housing member 12 has an opening on one end and a bottom wall on the other end. The cylindrical discharge housing member 13 has a circumferential wall coupled to one end of the suction housing member 12 and an end wall. The suction housing member 12 accommodates a compression mechanism 14 for compressing refrigerant and an electric motor 15, which is a driving source for the compression mechanism 14.

On the outer surface of the bottom wall of the suction housing member 12 is secured a closed-end cylindrical cover member 16 formed of metal material (in the present embodiment, aluminum). A motor drive circuit 17 is secured to the bottom wall of the suction housing member 12 in a space defined by the bottom wall of the suction housing member 12 and the cover member 16.

Near the opening of the suction housing member 12 is secured a shaft support member 18. The shaft support member 18 includes a through hole 18*a* at the radial center. The shaft support member 18 and the suction housing member 12 define a motor chamber 12*a* for accommodating the electric motor 15. The suction housing member 12 accommodates a rotary shaft 19. A first end of the rotary shaft 19 is located in the through hole 18*a* of the shaft support member 18 and is rotationally supported by the shaft support member 18 via a bearing B1. A second end of the rotary shaft 19 is rotationally supported by the suction housing member 12 at the bottom wall via a bearing B2. The bearings B1, B2 are plain bearings.

The electric motor 15 includes a rotor 15*a* that rotates integrally with the rotary shaft 19 and a stator 15*b* secured to the inner circumferential surface of the suction housing member 12 to surround the rotor 15*a*.

The compression mechanism 14 includes a fixed scroll 20 and a movable scroll 21. The fixed scroll 20 includes a disk-like fixed base 20*a* and a fixed volute wall 20*b* extending from the fixed base 20*a*. The movable scroll 21 includes a disk-like movable base 21*a* and a movable volute wall 21*b* extending from the movable base 21*a* toward the fixed base 20*a*. In the present embodiment, the compression mechanism 14, the electric motor 15, and the motor drive circuit 17 are arranged in this order along the rotation axis L of the rotary shaft 19.

The rotary shaft 19 has, on the end face of its first end, an eccentric shaft 19*a* displaced from the rotation axis L. A bush 19*b* is fitted and secured on the eccentric shaft 19*a*. The movable base 21*a* is supported on the bush 19*b* to be rotational relative to the bush 19*b* via a bearing B3.

The fixed volute wall 20*b* and the movable volute wall 21*b* are engaged with each other. The distal end face of the fixed volute wall 20*b* contacts the movable base 21*a*, and the distal end of the movable volute wall 21*b* contacts the fixed base 20*a*. The fixed scroll 20 and the movable scroll 21 define a compression chamber 22 between them.

Between the movable base 21*a* and the shaft support member 18 is arranged an anti-rotation mechanism 23. The movable base 21*a* has multiple circular holes 23*a* in the surface facing the shaft support member 18. The anti-rotation mechanism 23 includes the circular holes 23*a* and multiple pins 23*b* provided on the surface of the shaft support member 18 facing the movable base 21*a*. The pins 23*b* are inserted in the corresponding circular holes 23*a*.

When the electric motor 15 rotates the rotary shaft 19, the movable scroll 21 supported by the eccentric shaft 19*a* orbits around the rotation axis L of the rotary shaft 19. At this time, the movable scroll 21 is prevented from rotating by the anti-rotation mechanism 23 and is permitted to only orbit. As the movable scroll 21 orbits, the volume of the compression chamber 22 is reduced.

A suction chamber 25 that communicates with the compression chamber 22 is defined between the outer circumferential wall of the fixed scroll 20 and the radially outermost section of the movable volute wall 21*b*. A recess 26 is formed in the outer circumferential surface of the outer circumferential wall of the fixed scroll 20. The region surrounded by the recess 26 and the inner circumferential surface of the suction housing member 12 forms a suction passage 28. The suction passage 28 is connected to the suction chamber 25 via a through hole 27 formed in the outer circumferential wall of the fixed scroll 20. The motor chamber 12*a* is connected to the suction passage 28 via a hole 18*h* extending through the outer circumferential portion of the shaft support member 18.

The suction housing member 12 includes a suction port 29. The suction port 29 is connected to an external refrigerant circuit 50. Refrigerant gas from the external refrigerant circuit 50 passes through the suction port 29 and is drawn into the motor chamber 12*a*. The refrigerant gas drawn into the motor chamber 12*a* passes through the hole 18*h*, the suction passage 28, the through hole 27, and the suction chamber 25 and is drawn into the compression chamber 22.

The fixed base 20*a* includes, at its radial center, a discharge port 20*e* connected to the compression chamber 22. The fixed base 20*a* includes, at positions radially outward of the discharge port 20*e*, two sub-ports 20*s* connected to the compression chamber 22. The two sub-ports 20*s* are arranged with the discharge port 20*e* in between with respect to the radial direction of the fixed base 20*a*. To the fixed base 20*a* are attached a valve plate 30 and a retainer plate 31. The valve plate 30 includes three discharge valves 30*v* covering the discharge port 20*e* and the two sub-ports 20*s*. The retainer plate 31 includes three retainers 31*a* regulating the opening degree of the corresponding discharge valves 30*v*.

The discharge housing member 13 defines a discharge chamber 32 and an oil separation chamber 34. The refrigerant gas compressed in the compression chamber 22 is discharged into the discharge chamber 32 through the discharge port 20*e* and the two sub-ports 20*s*. A cylindrical oil separation tube 33 is arranged in the oil separation chamber 34. The oil separation tube 33 separates lubricant contained in the refrigerant gas that is discharged to the discharge chamber 32 from the refrigerant gas. The discharge chamber 32 is formed between the fixed base 20*a* and the discharge housing member 13. The oil separation tube 33 includes a large diameter portion 33*a* and a small diameter portion 33*b*. The large diameter portion 33*a* is fitted to the inner circumferential wall of the oil separation chamber 34. The small diameter portion 33*b* extends downward from the large diameter portion 33*a* and has a diameter smaller than that of the large diameter portion 33*a*.

A cylindrical wall 35, which defines the discharge chamber 32 and the oil separation chamber 34, or separates the discharge chamber 32 and the oil separation chamber 34 from each other, is formed on an end wall 13*a* of the discharge housing member 13. The cylindrical wall 35 bulges into the discharge chamber 32 and extends from the upper section of the discharge chamber 32 toward the lower section of the discharge chamber 32. That is, the compressor 10 is installed such that the cylindrical wall 35 extends from the upper section toward the lower section in the direction of gravity. The cylindrical wall 35 includes, at its upper section, a communication hole 36 connecting the discharge chamber 32 to the oil separation chamber 34. The communication hole 36 is arranged to open toward the upper outer circumferential surface of the small diameter portion 33*b*.

The lower part of the oil separation chamber 34 and the through hole 18*a* of the shaft support member 18 are connected through a supply passage 40 extending through the discharge housing member 13, the fixed scroll 20, and the shaft support member 18. Also, the rotary shaft 19 includes a first in-shaft passage 19*c* extending along the rotation axis L. The rear end of the first in-shaft passage 19*c* is open to a clearance 41 between the bottom wall of the suction housing member 12 and the end face of the rotary shaft 19 facing the bottom wall of the suction housing member 12. The rotary shaft 19 further includes a second in-shaft passage 19*d* extending in the radial direction of the rotary shaft 19. One end of the second in-shaft passage 19*d* is connected to the front end of the first in-shaft passage 19*c*, and the other end is open in the through hole 18*a* of the shaft support member 18.

The refrigerant gas that has flowed through the communication hole 36 into the oil separation chamber 34 is sprayed against the outer circumferential surface of the small diameter portion 33*b* and is guided downward in the oil separation chamber 34 while swirling around the small diameter portion 33*b*. At this time, lubricant is separated from the refrigerant gas by centrifugal separation. The lubricant separated from the refrigerant gas drops to the lower part of the oil separation chamber 34. The lubricant that has dropped to the lower part of the oil separation chamber 34 passes through the supply passage 40 together with the refrigerant gas in the oil separation chamber 34, moves into the through hole 18*a* of the shaft support member 18, and then passes through the bearing B1. The bearing B1 is lubricated by the lubricant that passes through the bearing B1. Furthermore, the lubricant in the through hole 18*a* moves to the clearance 41 through the second in-shaft passage 19*d* and the first in-shaft passage 19*c* together with the refrigerant gas and passes through the bearing B2. The bearing B2 is lubricated by the lubricant that passes through the bearing B2. The lubricant that has passed through the bearing B2 is returned to the motor chamber 12*a* together with the refrigerant gas.

The refrigerant gas from which the lubricant is separated by swirling around the small diameter portion 33*b* flows into the oil separation tube 33 from the lower opening of the small diameter portion 33*b*. The refrigerant gas that has flowed into the oil separation tube 33 flows to the external refrigerant circuit 50 and is returned to the motor chamber 12*a* through the suction port 29.

Figure 2:
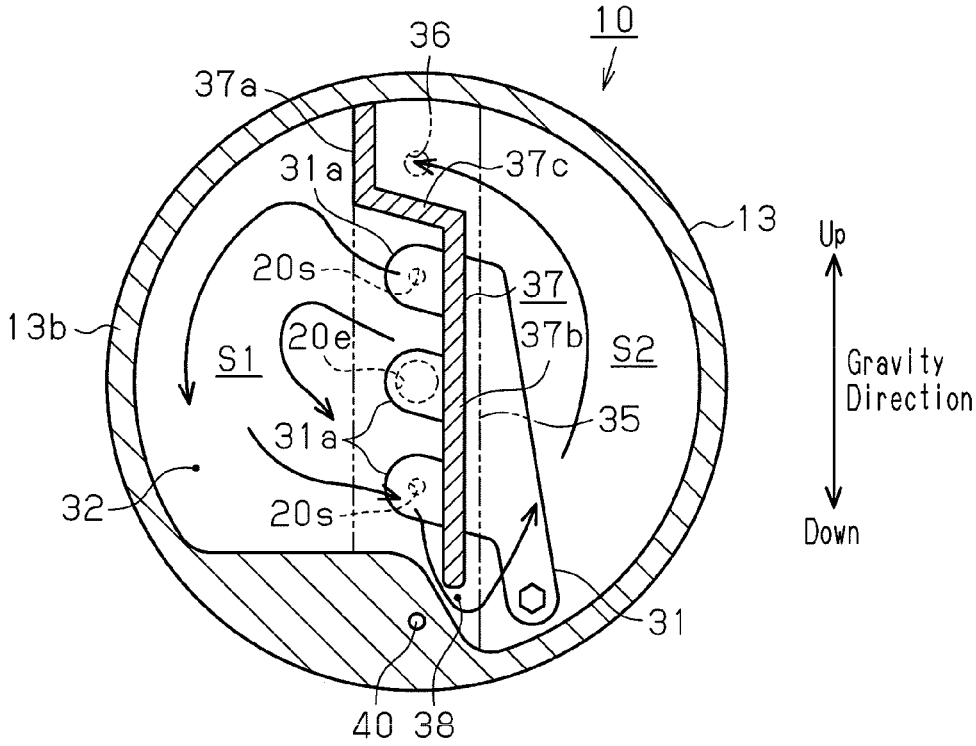
FIG. 2 is a cross-sectional view taken along line 2-2 in FIG. 1.

As shown in FIG. 2, the discharge housing member 13 includes a plate-like partition 37 in the discharge chamber 32. The partition 37 is continuous with the cylindrical wall 35, protrudes from the cylindrical wall 35, and extends from the upper section of the discharge chamber 32 toward the lower section of the discharge chamber 32 in the direction of gravity. The partition 37 divides the inside of the discharge chamber 32 into a first space S1, which is adjacent to the discharge port 20*e* and the two sub-ports 20*s*, and a second space S2, which is adjacent to the communication hole 36. The first space S1 and the second space S2 are connected at the lower sections of the discharge chamber 32 through a clearance 38 between the lower end of the partition 37 and a circumferential wall 13*b* of the discharge housing member 13. The communication hole 36 is located above the clearance 38 in the direction of gravity.

Figure 3:
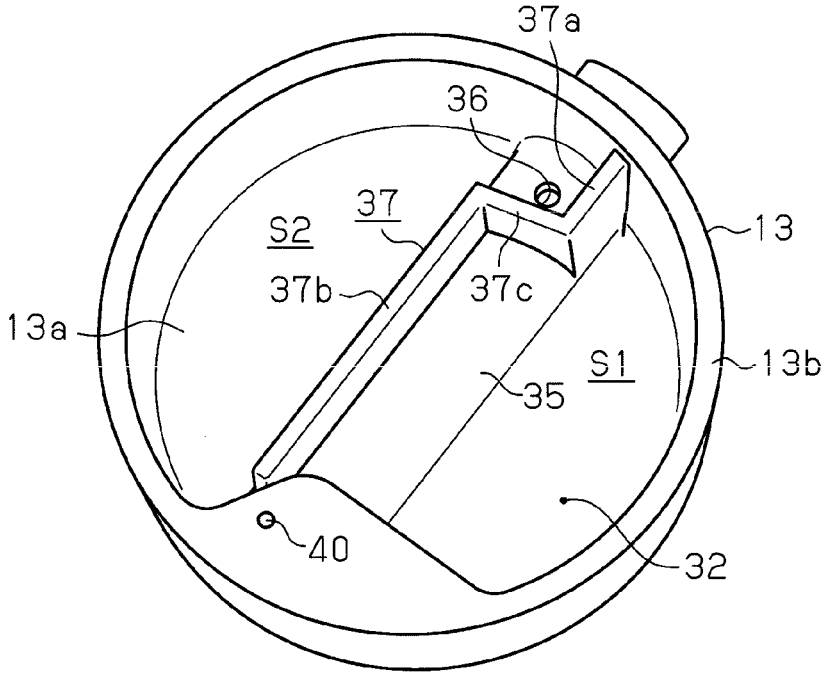
FIG. 3 is a perspective view illustrating the discharge housing member of the compressor of FIG. 1.

As shown in FIGS. 1 and 3, the height of the circumferential wall 13*b* is higher than that of the partition 37. That is, in the depth direction of the discharge housing member 13, the length of the circumferential wall 13*b* is longer than that of the partition 37. The partition 37 extends from the cylindrical wall 35 just short of the fixed base 20*a*, in other words, just short of a plane passing through the open end of the circumferential wall 13*b*.

As shown in FIGS. 2 and 3, the partition 37 includes a first extended portion 37*a* and a second extended portion 37*b*, which extend straight in the extending direction of the cylindrical wall 35. The first extended portion 37*a* and the second extended portion 37*b* are arranged at different positions in a direction perpendicular to the extending direction of the cylindrical wall 35. The partition 37 further includes a coupling portion 37*c* that extends straight and connects the first extended portion 37*a* to the second extended portion 37*b*. The first extended portion 37*a* extends from the upper part of the circumferential wall 13*b* of the discharge housing member 13. The coupling portion 37*c* extends between the communication hole 36 and one of the sub-ports 20*s* located close to the communication hole 36. The second extended portion 37*b* extends from the coupling portion 37*c* toward the lower part of the circumferential wall 13*b* of the discharge housing member 13. An increase (or a decrease) in the volume ratio of the first space to the second space changes the frequency range of the discharge pulsation of the refrigerant gas. The present embodiment sets the volume ratio of the first space S1 and the second space S2 in accordance with the frequency range of the discharge pulsation of the refrigerant gas by forming the partition 37 into the shape as described above.

As shown in FIG. 3, the partition 37 is formed integrally with the cylindrical wall 35 by die casting. The first extended portion 37*a* protrudes from the boundary between the cylindrical wall 35 and the end wall 13*a* of the discharge housing member 13. The second extended portion 37*b* and the coupling portion 37*c* protrude from the outer circumferential surface of the cylindrical wall 35.

Operation of the present embodiment will now be described.

As shown in FIG. 2, when the movable scroll 21 orbits, the refrigerant gas is compressed in the compression chamber 22 and passes through the discharge port 20*e* and the two sub-ports 20*s*. The refrigerant gas presses open the discharge valves 30*v* and is then discharged to the first space S1 of the discharge chamber 32. The refrigerant gas discharged to the first space S1 is guided downward along the partition 37 and passes through the clearance 38 between the lower end of the partition 37 and the circumferential wall 13*b* of the discharge housing member 13 into the second space S2. The refrigerant gas that has flowed into the second space S2 flows toward the communication hole 36. Thus, the lubricant separated from the refrigerant gas in the discharge chamber 32 is restrained from accumulating in the lower part of the discharge chamber 32.

The above described embodiment provides the following advantages.

(1) The discharge housing member 13 includes the partition 37 in the discharge chamber 32. The partition 37 is continuous with and protrudes from the cylindrical wall 35 and extends from the upper section toward the lower section. The partition 37 divides the inside of the discharge chamber 32 into the first space S1, which is adjacent to the discharge port 20*e*, and the second space S2, which is adjacent to the communication hole 36. The first space S1 and the second space S2 are connected at the lower sections thereof through the clearance 38 between the lower end of the partition 37 and the circumferential wall 13*b* of the discharge housing member 13. The structure allows the refrigerant gas that has been discharged from the compression chamber 22 into the first space S1 of the discharge chamber 32 through the discharge port 20*e* to be guided downward along the partition 37 and flow into the second space S2 through the clearance 38, which is formed between the lower end of the partition 37 and the circumferential wall 13*b* of the discharge housing member 13. Since the refrigerant gas that has flowed into the second space S2 flows toward the communication hole 36, the lubricant separated from the refrigerant gas in the discharge chamber 32 is restrained from accumulating in the lower part of the discharge chamber 32. Furthermore, the partition 37 protrudes from the cylindrical wall 35. Thus, as compared to a case where the partition does not protrude from the cylindrical wall 35 and protrudes from the end wall 13*a* of the discharge housing member 13, the length of the partition 37 in the depth direction of the discharge housing member 13 is reduced. This simplifies manufacturing of the partition 37. Thus, the lubricant separated in the discharge chamber 32 is restrained from accumulating in the lower part of the discharge chamber 32 with a simple structure.

(2) The partition 37 includes the first extended portion 37*a* and the second extended portion 37*b*, which extend straight in the extending direction of the cylindrical wall 35. The first extended portion 37*a* and the second extended portion 37*b* are arranged at different positions in the direction perpendicular to the extending direction of the cylindrical wall 35.

The partition 37 further includes the coupling portion 37*c*, which connects the first extended portion 37*a* to the second extended portion 37*b*. That is, the partition 37 is bent substantially like a crank. The structure improves the strength of the partition 37 as compared to a case where the partition is formed to simply extend straight in the extending direction of the cylindrical wall 35. Consequently, the partition 37 can be made thin allowing the volume of the discharge chamber 32 to be easily increased. This efficiently reduces the discharge pulsation of the refrigerant gas discharged into the discharge chamber 32.

(3) Δn increase (or a decrease) in the volume ratio of the first space to the second space changes the frequency range of the discharge pulsation of the refrigerant gas. In the present embodiment, since the volume ratio of the first space S1 and the second space S2 is set in accordance with the frequency range of the discharge pulsation of the refrigerant gas, the discharge pulsation of the refrigerant gas is efficiently reduced.

(4) In order to reduce the discharge pulsation of the refrigerant gas discharged into the discharge chamber 32, the length of the circumferential wall in the depth direction of the discharge housing member has been increased to sufficiently increase the volume of the discharge chamber. However, the greater the volume of the discharge chamber 32, the more easily the lubricant separated from the refrigerant gas in the discharge chamber 32 tends to accumulate in the lower part of the discharge chamber 32. In the present embodiment, however, the refrigerant gas discharged from the compression chamber 22 into the discharge chamber 32 through the discharge port 20*e* is guided along the partition 37 and flows through the clearance 38, which is located between the lower end of the partition 37 and the circumferential wall 13*b* of the discharge housing member 13, toward the communication hole 36. Thus, although the volume of the discharge chamber 32 is increased to reduce the discharge pulsation of the refrigerant gas, the lubricant separated from the refrigerant gas in the discharge chamber 32 is restrained from accumulating in the lower part of the discharge chamber 32.

(5) The first extended portion 37*a* and the second extended portion 37*b* extend straight in the extending direction of the cylindrical wall 35 and are arranged at different positions in the direction perpendicular to the extending direction of the cylindrical wall 35. In a case where the extended portions extend in a direction intersecting the extending direction of the cylindrical wall 35, the boundary between the extended portions and the cylindrical wall 35 curves along the outer circumferential surface of the cylindrical wall 35. In the present embodiment, however, the boundary between the extended portions 37*a*, 37*b* and the cylindrical wall 35 extends straight without curving. The present embodiment thus increases the strength of the boundary between the partition 37 and the cylindrical wall 35 and improves the productivity in die casting the partition 37 integrally with the cylindrical wall 35.

(6) When the scroll compressor 10 is operated at a low speed, the lubricant accumulated in the discharge chamber 32 is not stirred up to the communication hole 36 as reliably as when the scroll compressor 10 is operated at a high speed. In the present embodiment, however, the refrigerant gas discharged from the compression chamber 22 into the discharge chamber 32 through the discharge port 20*e* is guided along the partition 37 and flows through the clearance 38, which is located between the lower end of the partition 37 and the circumferential wall 13*b* of the discharge housing member 13, toward the communication hole 36. Thus, during operation at a low speed also, the lubricant separated from the refrigerant gas in the discharge chamber 32 is stirred up to the communication hole 36 in a suitable manner and is restrained from accumulating in the lower part of the discharge chamber 32.

(7) In the present embodiment, since the lubricant separated from the refrigerant gas in the discharge chamber 32 is restrained from accumulating in the lower part of the discharge chamber 32, a predicted amount of extra lubricant does not need to be included in the compressor in advance in anticipation of accumulation of lubricant in the lower part of the discharge chamber 32. This reduces manufacturing costs.

The above described embodiment may be modified as follows.

In the above illustrated embodiment, the partition 37 may be formed to simply extend straight in the extending direction of the cylindrical wall 35.

In the above illustrated embodiment, the first extended portion 37*a* does not need to protrude from the boundary between the cylindrical wall 35 and the end wall 13*a* of the discharge housing member 13. For example, the first extended portion 37*a* may protrude from the outer circumferential surface of the cylindrical wall 35.

In the above illustrated embodiment, the second extended portion 37*b* may protrude from the boundary between the cylindrical wall 35 and the end wall 13*a* of the discharge housing member 13.

In the above illustrated embodiment, the first extended portion 37*a* may extend in a direction intersecting the extending direction of the cylindrical wall 35.

In the above illustrated embodiment, the second extended portion 37*b* may extend in a direction intersecting the extending direction of the cylindrical wall 35.

In the above illustrated embodiment, the oil separation tube 33 may be, for example, a polygonal tube such as a rectangular tube. In this case, the cylindrical wall 35 may also have, for example, a polygonal shape such as a rectangular shape.

In the above illustrated embodiment, the cylindrical wall 35 may extend from the upper section toward the lower section while tilting relative to the gravity direction. That is, the compressor 10 may be installed such that the cylindrical wall 35 extends either in the gravity direction or in a direction inclined relative to the gravity direction.

In the above illustrated embodiment, the sub-ports 20*s* and the discharge valves 30*v* that cover the sub-ports 20*s* may be omitted.

In the above illustrated embodiment, the scroll compressor 10 does not need to be used in a vehicle air conditioning system, but may be used in other air conditioning systems.

In the above illustrated embodiment, the compressor does not necessarily have to be a scroll compressor, but may be for example, a vane compressor or a Roots compressor.

Therefore, the present examples and embodiments are to be considered as illustrative and not restrictive and the invention is not to be limited to the details given herein, but may be modified within the scope and equivalence of the appended claims.

What is claimed is:

1. A compressor, comprising:

a rotary shaft:

a compression mechanism that includes a compression chamber and that is configured to compress refrigerant gas in the compression chamber in response to rotation of the rotary shaft;

a discharge port connected to the compression chamber;

a cylindrical discharge housing member including an end wall that is perpendicular to an axial direction of the rotary shaft, and a circumferential wall;

a discharge chamber that is provided in the cylindrical discharge housing member and that is configured to receive the refrigerant gas compressed in the compression chamber and discharged via the discharge port;

an oil separation chamber that is provided in the cylindrical discharge housing member, the oil separation chamber accommodates an oil separation tube that is configured to separate lubricant contained in the refrigerant gas discharged to the discharge chamber from the refrigerant gas;

a cylindrical wall that is provided on the end wall of the cylindrical discharge housing member and that extends in a radial direction of the rotary shaft, the cylindrical wall separates the discharge chamber and the oil separation chamber from each other; and a partition that is provided in the discharge chamber, the partition is continuous with and protrudes from the cylindrical wall in the axial direction of the rotary shaft, wherein the cylindrical wall and the end wall define the oil separation chamber therebetween, the cylindrical wall bulges into the discharge chamber in the axial direction of the rotary shaft and extends from an upper section of the discharge chamber toward a lower section of the discharge chamber, and the cylindrical wall includes, at a position corresponding to the upper section, a communication hole connecting the discharge chamber to the oil separation chamber, the partition extends from the upper section of the discharge chamber toward the lower section of the discharge chamber and defines a first space that communicates with the discharge port and a second space that communicates with the communication hole in the discharge chamber, and the first space and the second space are connected to each other at least at the lower section of the discharge chamber through a clearance between the partition and the circumferential wall.

2. The compressor according to claim 1, wherein the partition includes a plurality of extended portions extending in the radial direction of the rotary shaft and arranged at positions different from each other in a direction perpendicular to the radial direction of the rotary shaft, and a coupling portion connecting the extended portions together.

3. The compressor according to claim 2, wherein at least one of the extended portions protrudes from a boundary between the cylindrical wall and the end wall of the discharge housing member.

4. The compressor according to claim 2, wherein the coupling portion protrudes from an outer circumferential surface of the cylindrical wall.

5. The compressor according to claim 1, wherein a volume ratio of the first space and the second space is set in accordance with a frequency range of discharge pulsation of the refrigerant gas.

6. The compressor according to claim 1, wherein, in a depth direction of the discharge housing member, a length of the circumferential wall is longer than a length of the partition.

7. The compressor according to claim 1, wherein the discharge port faces the communication hole and is arranged below the communication hole.

8. The compressor according to claim 1, wherein the communication hole is arranged above a portion of the partition that protrudes from the cylinder wall.

9. The compressor according to claim 1, wherein the circumferential wall and the end wall define a part of a contour of the compressor.

10. The compressor according to claim 1, wherein as viewed in the axial direction of the rotary shaft, the first space is located at one of right and left sides of the partition, and the second space is located at the other of the right and left sides of the partition.

* * * * *